US007503548B2

(12) United States Patent
Arzberger et al.

(10) Patent No.: US 7,503,548 B2
(45) Date of Patent: Mar. 17, 2009

(54) WINCH DEVICE

(75) Inventors: Maximilian Arzberger, Igenhausen (DE); Christian Johannes Ostermaier, Ingolstadt (DE); Ludwig Andreas Huber, Thalhausen (DE); Ignaz Seitle, Karlshuld (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 12/010,410

(22) Filed: Jan. 24, 2008

(65) Prior Publication Data

US 2008/0191182 A1 Aug. 14, 2008

(30) Foreign Application Priority Data

Feb. 8, 2007 (EP) ..... 07002750

(51) Int. Cl.
*B66D 1/14* (2006.01)

(52) U.S. Cl. ..... 254/294; 254/316; 254/312; 254/313

(58) Field of Classification Search ..... 254/293, 254/294, 312, 313, 316
See application file for complete search history.

(56) References Cited

U.S. PATENT DOCUMENTS

| | | | | | |
|---|---|---|---|---|---|
| 505,065 | A * | 9/1893 | Shaw | 414/626 |
| 1,509,109 | A * | 9/1924 | McLachlan | 254/296 |
| 1,741,315 | A * | 12/1929 | Kendall | 254/280 |
| 1,958,037 | A * | 5/1934 | Engler | 254/290 |
| 2,370,834 | A | 3/1945 | Ball | |
| 2,720,951 | A * | 10/1955 | Olson | 477/22 |
| 3,386,704 | A * | 6/1968 | Dawson | 254/299 |
| 3,572,703 | A * | 3/1971 | Greene | 273/448 |
| 3,927,867 | A * | 12/1975 | Herchenroder | 254/313 |
| 4,635,875 | A * | 1/1987 | Apple | 242/155 BW |
| 5,607,142 | A * | 3/1997 | Nilsson | 254/298 |
| 6,827,334 | B2 * | 12/2004 | Volle et al. | 254/285 |
| 7,210,670 | B2 * | 5/2007 | Franks | 254/294 |
| 2005/0006181 | A1 | 1/2005 | Lee | |

FOREIGN PATENT DOCUMENTS

| | | |
|---|---|---|
| AT | 309011 B | 7/1973 |
| DE | 24 06 112 | 8/1975 |
| DE | 33 45 763 | 6/1985 |
| DE | 3710132 | 10/1988 |
| GB | 1 255 884 | 12/1971 |
| JP | 52147849 | 12/1977 |

* cited by examiner

*Primary Examiner*—Emmanuel M Marcelo
(74) *Attorney, Agent, or Firm*—Jacobson Holman PLLC

(57) ABSTRACT

The invention relates to a winch device with a first winch having a first winch drum and a second winch having a second winch drum. There is also a synchronizing device through which a rotation of the first winch drum can be synchronized with the rotation of the second winch drum. Further, a differential shaft with a first synchronous wheel and a second synchronous wheel is provided, said first synchronous wheel being connected via a first rotary connection device to a first drive and the second synchronous wheel is connected via a second rotary connection device to the second drive.

11 Claims, 4 Drawing Sheets

WINCH DEVICE

BACKGROUND OF THE INVENTION

1. Field of the Invention

The invention relates to a winch mechanism having a first winch with a first winch drum driven in rotary manner by a first drive via a first gear, a second winch with a second winch drum driven in rotary manner by a second drive via a second gear, and a synchronizing device making it possible to synchronous a rotation of the first winch drum with a rotation of the second winch drum.

2. Related Art

Such double winch mechanisms with two winch drums and two separate drives are more particularly used for cranes and other lifting devices. A force distribution over at least two cables is advantageous for strength and safety reasons. Production and cost advantages result from the use of two smaller drives in place of one large drive. The use of two winch drums basically permits a joint and a separate operation of the cables, so that high functionality results from such a winch mechanism.

Such a winch mechanism can e.g. be gathered from JP 52147849 A. The two winch drums are in each case driven by a hydraulic motor. The two hydraulic motors can be synchronized by a corresponding hydraulic connection. However, even minor leaks in the hydraulic system can impair synchronization.

AT 309 011 B discloses a device for controlling the synchronism of at least two motor-moved winches, synchronization being brought about by a relay connection. However, due to their sensitivity, electrical and electronic components can lead to malfunctions, e.g. when used in construction machines under rough construction site conditions.

A gear for driving two drum winches can be gathered from DE 37 10 132 C2. In this case the two winch drums are driven by means of a common main driving motor, so that necessarily synchronization takes place. A differentiated drive of the two drums can be achieved using a positioning motor via a corresponding gear adjustment.

SUMMARY OF THE INVENTION

The object of the invention is to provide a winch device which, in the case of a compact, simple construction, permits a particularly reliable synchronization of the two winch drives.

According to the invention this object is achieved by a winch device having the features of claim 1. Preferred embodiments of the invention are given in the dependent claims.

The winch device according to the invention is characterized in that a differential shaft with a first synchronous wheel and a second synchronous wheel is provided and that the first synchronous wheel is connected via a first rotary connection device to the first drive and the second synchronous wheel via a second rotary connection device to the second drive.

According to the invention this leads to a simple and reliable mechanical synchronization of the two winch drums of the winch device. The differential shaft presets the uniform speed of the two drives. By means of the differential shaft there is an adaptation and matching of different speeds of the two drive motors. Here, complicated hydraulic or electrical control devices become unnecessary. The synchronous wheel can be constructed as a separate part or integrally with the differential shaft.

It is particularly preferred according to the invention for at least one coupling device to be provided with which a rotary connection of at least one of the drives to the differential shaft can be disengaged. Once the coupling device has been disengaged, there can be a differentiated drive of the two winch drums. Only when a synchronized movement of the two drives is required can the coupling device be operated and in this way via the differential shaft a speed and/or torque adaptation or matching can take place.

The coupling devices can be constituted by virtually all known couplings. According to the invention, in a particularly advantageous construction, at least one of the synchronous wheels is pivoted on the differential shaft and the coupling device connects the pivoted synchronous wheel to rotate with the differential shaft. According to the invention the coupling device is provided on the differential shaft. As a result the two winches can have an identical construction, which is efficient from the manufacturing standpoint. For as long as the pivoted synchronous wheel is not connected to rotate with the differential shaft, it is possible to drive the winch drums at different speeds. Only when the pivoted synchronous wheel is connected in positive and/or non-positive manner to the differential shaft, particularly by an axial coupling movement, does synchronization take place. Preferably there is a frictional rotary connection in the coupling device, such as by a coupling disk arrangement, so that by a slow operation, e.g. by pneumatically or hydraulically operated regulating units, is permitted a correspondingly slow speed adaptation without torque surges.

Basically, the rotary connection device can be a pinion arrangement or a chain. According to the invention it is advantageous for the rotary connection device to comprise a driving belt, which can have a flat, V or poly-V profile, but it is preferably a toothed belt.

Basically, the gears of the two winches are constructed as reduction gears. With such reduction gears a high speed of the driven shaft of the drive is reduced to a lower speed for winch drum rotation, so that a corresponding torque increase occurs. According to the invention it is particularly advantageous that the compensating shaft is in each case driven directly by means of the rotary connection device via a given driven shaft of the drives. Thus, speed adaptation takes place directly between the speeds of the two driven shafts with relatively low torques. This permits a compact arrangement and construction of the differential shaft and the coupling device.

A particularly compact and at the same time high reduction ratio is inventively achieved in that the first gear and the second gear have at least one and preferably three planetary gear stages or speeds. The planetary gear stages of the two winches are preferably constructed identically with the same reduction ratio, so that in the case of speed adaptation the differential shaft drives the two winch drums at the same speed and with the same torque.

The compact construction of an inventive winch device is assisted in that in each winch the driving shaft and the winch drum are coaxial to one another. The winch drum is constructed as a hollow cylinder in whose interior is provided the gear and into which projects the driving shaft.

According to the invention a particularly compact arrangement with a good symmetrical force distribution is achieved in that the driving shafts and winch drums are oriented parallel to the differential shaft and that the latter is positioned centrally between the two winch drums. A mirror symmetrical arrangement of the two winches to a centre plane through the differential shaft ensures a reliable compensation of transverse forces on said differential shaft. This is also advantageous for a simple and compact construction.

According to another preferred embodiment of the inventive winch device, for driving the differential shaft is provided a first extension shaft, which is connected in rotary manner to the first driving shaft, together with a second extension shaft, which is connected to rotate with the second driving shaft, and that the first extension shaft and second extension shaft project from a housing for bearing the winch drums. Through the use of an extension shaft attached in detachable manner to the driving shaft, a conventional winch can be easily adapted for the invention. The extension shafts project out of a bearing housing of the winch drums, so that a rotary connection with the differential shaft can easily be constructed on the outside of the housing.

According to the invention, a cost and manufacturing advantage results from the first and second winches having an identical construction.

BRIEF DESCRIPTION OF THE DRAWINGS

The invention is described in greater detail hereinafter relative to a preferred embodiment and the attached diagrammatic drawings, wherein show.

DETAILED DESCRIPTION OF THE PREFERRED EMBODIMENTS

Figure 1:
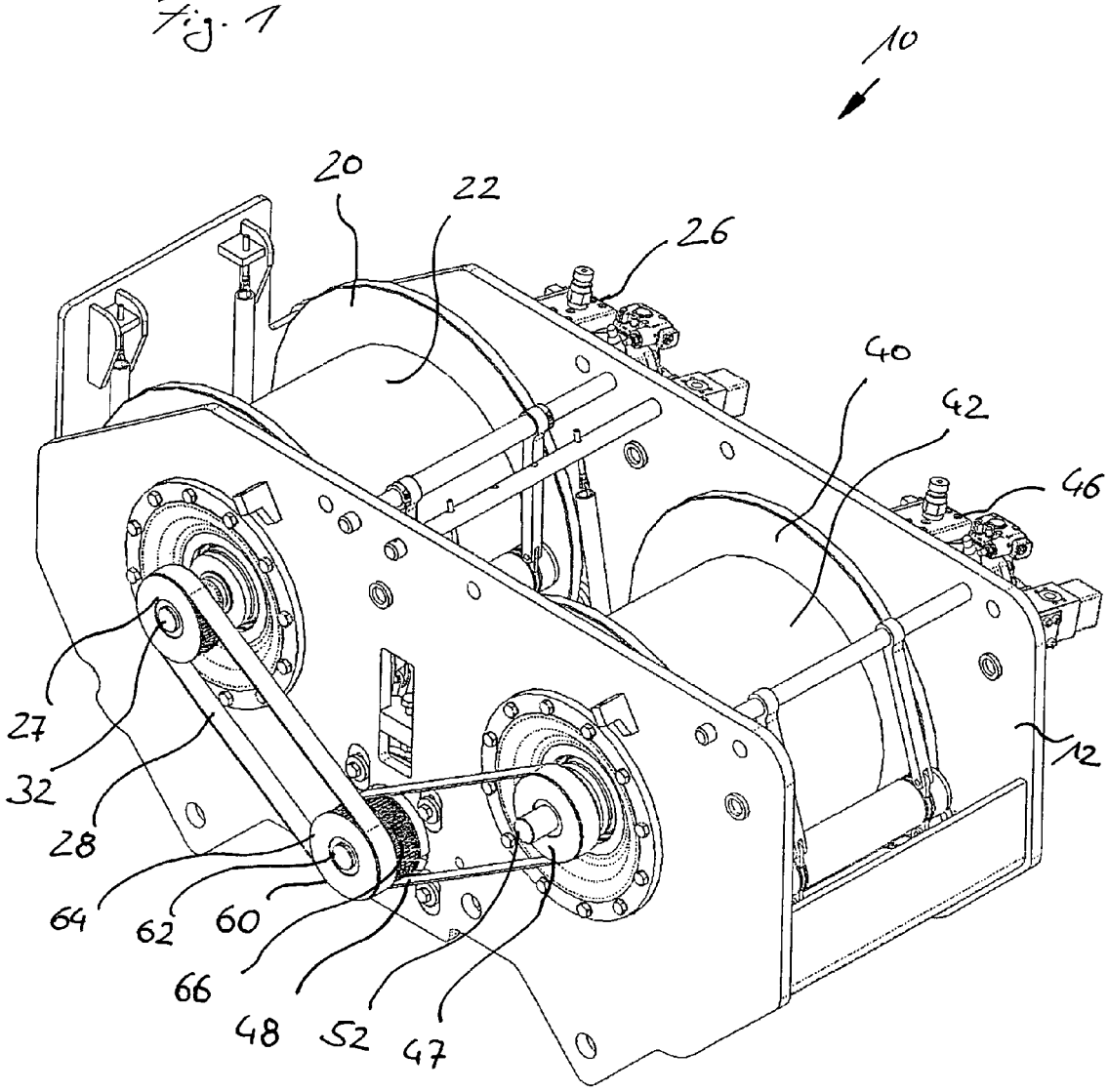
FIG. 1 A diagrammatic view of the inventive winch device.
Figure 2:
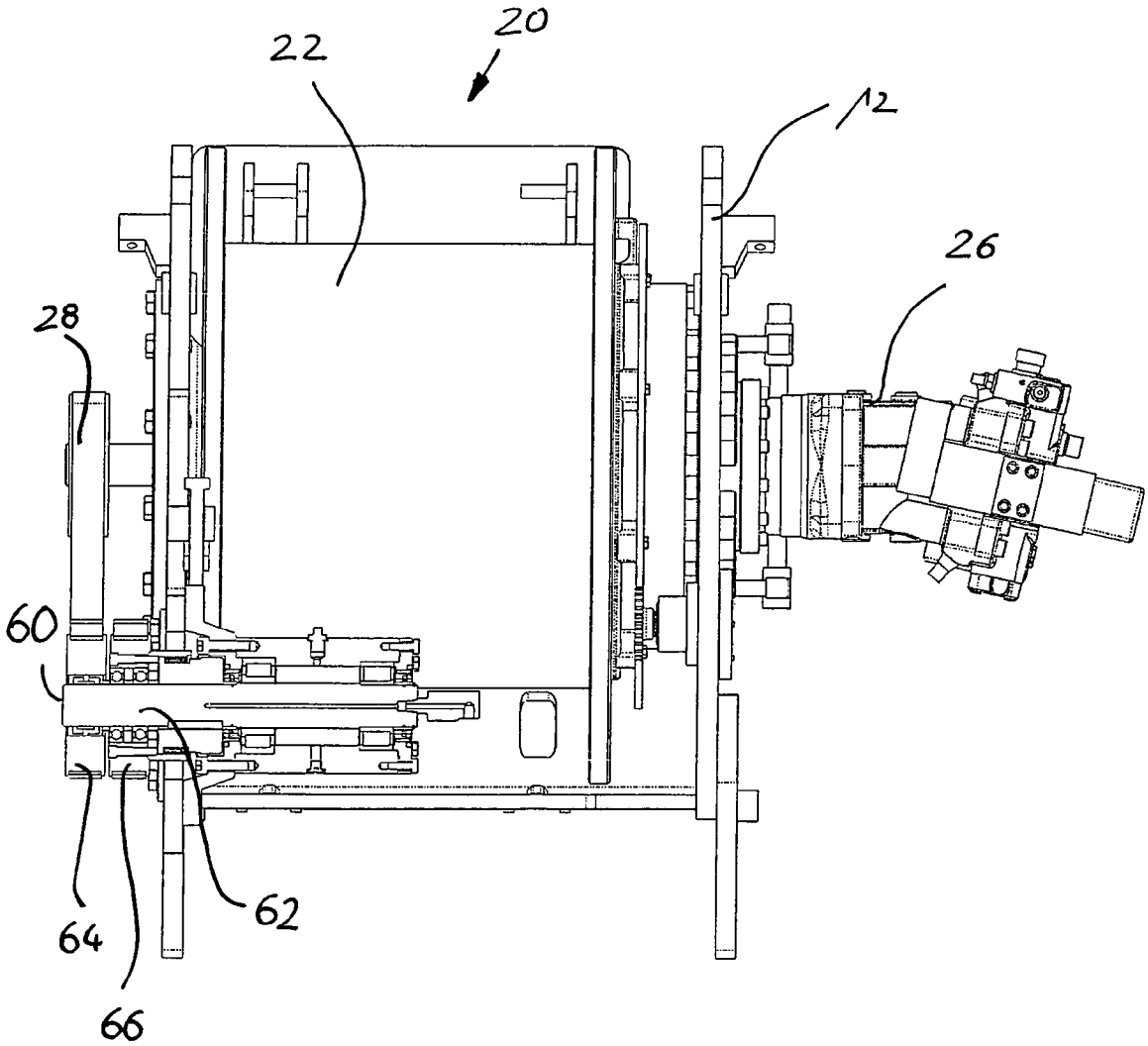
FIG. 2 A part cross-sectional view of the winch device.

According to FIGS. 1 and 2 an inventive winch device 10 has a box-type, top open housing 12, in which are positioned in parallel, juxtaposed manner a first winch 20 and a second winch 40. A first winch drum 22 and a second winch drum 42 are pivotably mounted in housing 12. A synchronizing device 60 with a differential shaft 62 is positioned centrally between the two winches 20, 40. A first synchronous wheel 64 and a second synchronous wheel 66 are located on differential shaft 62, which projects from one side of housing 12.

The first synchronous wheel 64, which is connected to rotate with differential shaft 62, is in rotary connection with a first driving wheel 27 by means of a band-shaped, toothed driving belt 28. Said first driving wheel 27 is connected to rotate on an extension shaft 32 driven by means of a first, hydraulic drive 26 of the first winch 20. In the same way a second extension shaft 52 of the second winch 40 is driven by a second, hydraulic drive 46 of the second winch 40. A second driving wheel 47 is connected to rotate on said second extension shaft 52 and is in rotary connection by means of a second driving belt 48 with the second synchronous wheel 66 on differential shaft 62.

The arrangement of the synchronizing device 60 with the differential shaft 62 and the two synchronous wheels 64, 66 is shown in greater detail in FIG. 2.

Figure 3:
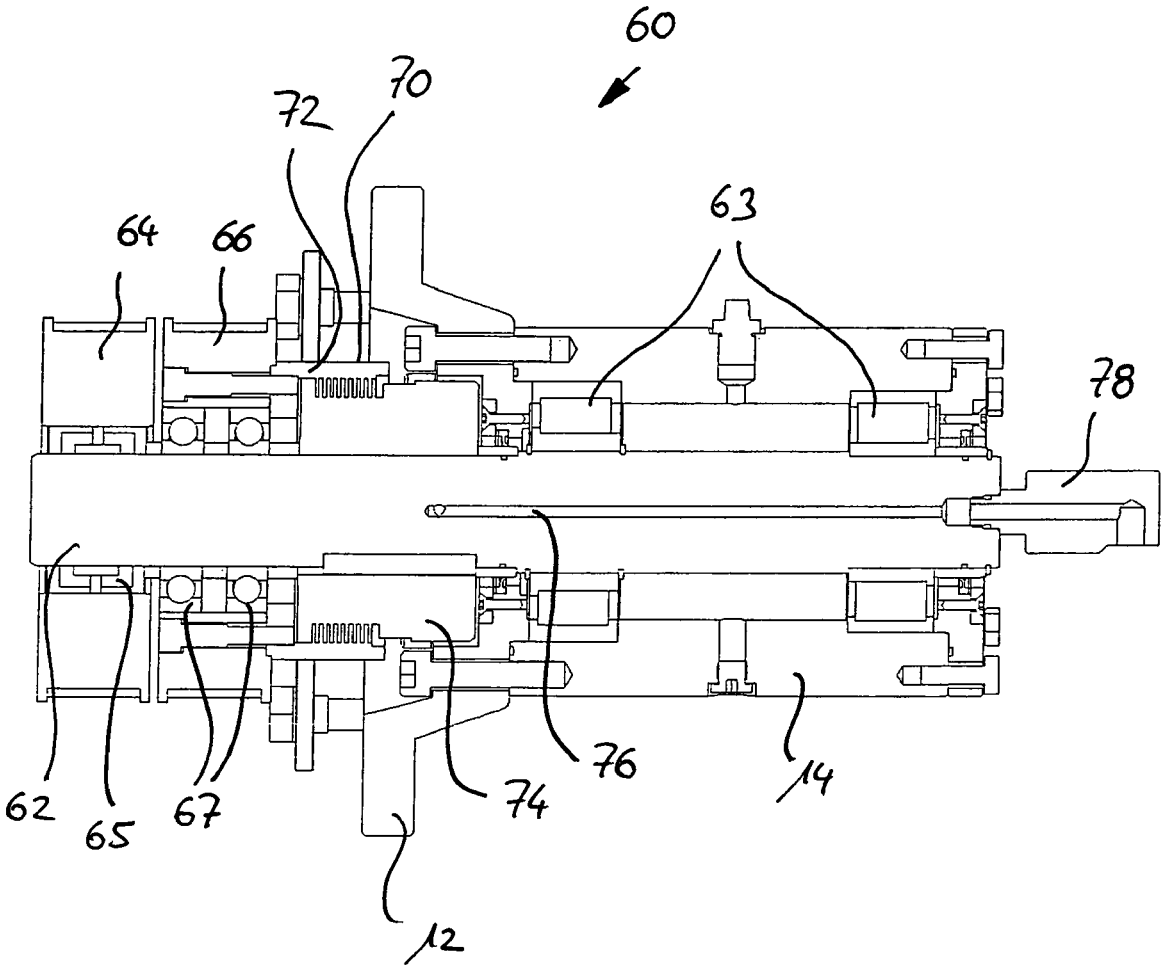
FIG. 3 A larger scale cross-sectional view of the region of the differential shaft of FIG. 2.

The construction and function of synchronizing device 60 is explained in greater detail hereinafter in connection with FIG. 3. Differential shaft 62 is pivoted by means of shaft bearings 63 with respect to a bearing sleeve 14 firmly fitted to housing 12.

The first synchronous wheel 64 is firmly connected to differential shaft 62 by a connected to rotate joint 65. However, the second synchronous wheel 66 is pivoted by means of pivoting bearing 67 on differential shaft 62. The second synchronous wheel 66 can be connected to rotate with differential shaft 62 via a coupling device 70, so that there is a synchronous rotation between the first synchronous wheel 64 and the second synchronous wheel 66.

Coupling device 70 comprises a first coupling element 72 with coupling disks connected by screw bolts in firm manner to the second synchronous wheel 66. Said first coupling element 72 is rotatable together with the second synchronous wheel 66 with respect to the differential shaft 62. Corresponding to the first coupling element 72, a second coupling element 74 with coupling disks is connected to rotate with the differential shaft 62. By means of a fluid supply 78 and fluid ducts 76 in differential shaft 62 coupling device 70 can be operated. On pressurization there is a relative displacement of the second coupling element 74 axial to the first coupling element 72, so that they are in each case frictionally interconnected via their coupling disks. As a result of said frictional connection there is a connected to rotate joint between the second synchronous wheel 66 and the differential shaft 62 via the second coupling element 74, which is positioned in connected to rotate, but axially displaceable manner on differential shaft 62.

Figure 4:
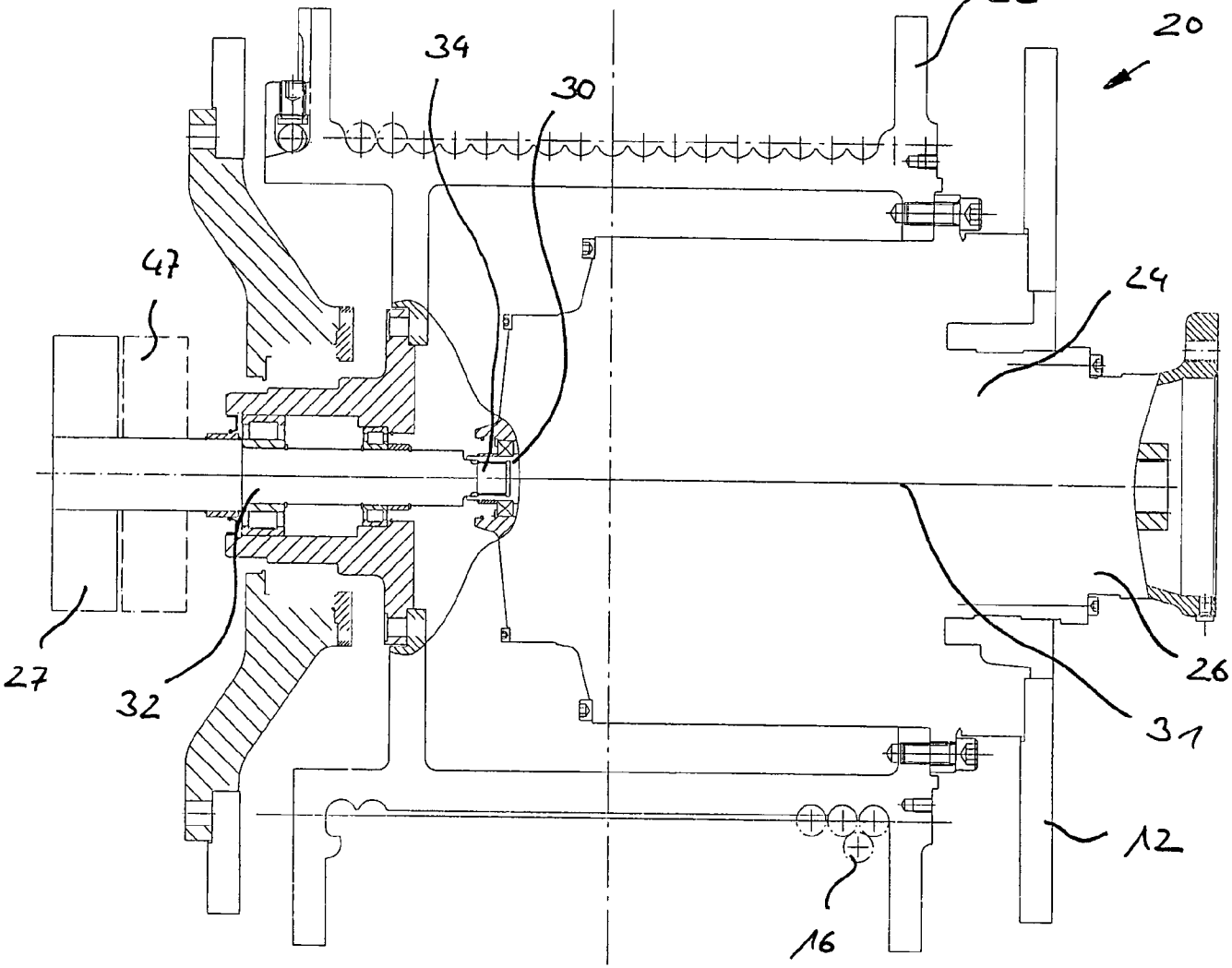
FIG. 4 A diagrammatic part cross-sectional view of a winch.

The diagrammatic construction of a winch is illustrated in FIG. 4 with respect to the first winch 20. The first winch 20 has a first winch drum 22 for operating a diagrammatically represented cable 16. A driving shaft 30 is driven by a first drive 26, which is a hydraulic drive. The drive takes place at high speed and low torque. By means of a not shown planetary gear arrangement the speed is reduced and the correspondingly increased torque is transmitted in known manner to the first winch drum 22. A rotation axis 31 of driving shaft 30 is coaxial to the rotation axis of the first winch drum 22.

By means of a shaft-hub connection 34 with a polygonal profile a first extension shaft 32 is mounted connected to rotate on driving shaft 30. By means of the extension shaft 32, which extends the first driving shaft 30 axially out of the housing 12, the first driving wheel 27 is driven. The first driving wheel 27 is fitted connected to rotate to the free end of the first extension shaft 32. The first winch 20 has an identical construction to the second winch 40, except for the arrangement of the second driving wheel 47, which is axially displaced with respect to the first driving wheel 27 of the first winch 20. Said axial displacement of the second driving wheel 47 is diagrammatically illustrated in FIG. 4 by the arrangement of the second driving wheel 47 shown in broken line form. The first extension shaft 32 and second extension shaft 52 have an identical construction and in each case have a receptacle for the two driving wheels 27, 47.

For as long as the coupling device 70 is not operated for bringing about a frictional connection, the first winch 20 and second winch 40 can be driven independently of one another. However, if it is necessary to operate the two winches 20, 40 at the same speed for a jointly matched lifting movement, coupling device 70 is operated. Through this the second synchronous wheel 66 on differential shaft 62 is now coupled connected to rotate therewith. In this way the rotary movements of the first extension shaft 32 and second extension shaft 52 are necessarily mechanically coupled together. By means of differential shaft 62 and the driving belts 28, 48 in the form of toothed belts there is a speed adaptation between the first winch 20 and second winch 40. This ensures in a reliable mechanical manner a synchronization of the two winches 20, 40. The synchronous wheels 64, 66 and the two driving wheels 27, 47 are constructed as sprockets, which are preferably identical.

The invention claimed is:

1. Winch device comprising:

a first drive and a first gear, a second drive and a second gear operable independently of the first drive and the first gear, a first winch with a first winch drum, driven in rotary manner by the first drive via the first gear, a second winch with a second winch drum driven in rotary manner by the second drive via the second gear, and a selectively operable synchronizing device through which a rotation of the first winch drum is selectively synchronizable with a rotation of the second winch drum, wherein the synchronizing device includes:

a differential shaft with a first synchronous wheel and a second synchronous wheel, and a first rotary connection device connecting the first synchronous wheel to the first drive and a second rotary connection device connecting the second synchronous wheel to the second drive.

2. Winch device according to claim 1, further comprising:

at least one coupling device providing a disengageable rotary connection between at least one of the drives to the differential shaft.

3. Winch device according to claim 2, wherein at least one of the synchronous wheels is pivoted on the differential shaft and through the coupling device the pivoted synchronous wheel is connectable to rotate with the differential shaft.

4. Winch device according to claim 1, wherein the rotary connection device comprises a driving belt.

5. Winch device according to claim 1, further comprising first and second driving shafts respectively associated with the first and second drives, wherein the differential shaft and rotary connection devices are in each case directly driven via a respective driving shaft of the first and second drives.

6. Winch device according to claim 5, wherein the driving shaft and winch drums are arranged coaxially to one another in each winch.

7. Winch device according to claim 5, wherein the driving shaft and winch drums are oriented parallel to the differential shaft and said differential shaft is positioned centrally between the two winch drums.

8. Winch device according to claim 5, further comprising:

a housing and a first extension shaft connected to rotate with the first driving shaft and a second extension shaft connected to rotate with the second driving shaft, for driving the differential shaft, wherein the first extension shaft and second extension shaft project from the housing for bearing the winch drums.

9. Winch device according to claim 1, wherein the first gear and the second gear have at least one planetary gear stage.

10. Winch device according to claim 1, wherein the first winch and second winch have an identical construction.

11. Winch device according to claim 1, wherein the first gear and the second gear have three planetary gear stages.

* * * * *